US008939729B2

(12) United States Patent
Hsieh et al.

(10) Patent No.: US 8,939,729 B2
(45) Date of Patent: Jan. 27, 2015

(54) FAN STRUCTURE

(75) Inventors: Chi-Hao Hsieh, Taoyuan Hsien (TW); Shu-Ying Yuan, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 576 days.

(21) Appl. No.: 13/282,056

(22) Filed: Oct. 26, 2011

(65) Prior Publication Data

US 2012/0114498 A1 May 10, 2012

(30) Foreign Application Priority Data

Nov. 5, 2010 (TW) ..... 99138038 A

(51) Int. Cl.
*F01D 5/14* (2006.01)
*F04D 29/38* (2006.01)

(52) U.S. Cl.
CPC ..... *F04D 29/384* (2013.01)
USPC ..... 416/236 A

(58) Field of Classification Search
CPC .... F04D 29/384; F04D 29/386; F04D 29/388
USPC ..... 416/197 R, 223 R, 227 A, 228, 231 B, 416/236 A, 236 R
See application file for complete search history.

(56) References Cited

U.S. PATENT DOCUMENTS

| | | | | |
|---|---|---|---|---|
| 1,366,635 | A * | 1/1921 | Conway | 416/236 R |
| 4,789,306 | A * | 12/1988 | Vorus et al. | 416/223 R |
| 4,844,698 | A * | 7/1989 | Gornstein et al. | 416/223 R |
| 6,497,385 | B1 * | 12/2002 | Wachspress et al. | 244/7 R |
| 6,733,241 | B2 * | 5/2004 | Bird | 416/238 |
| 2010/0266428 | A1 * | 10/2010 | Nakagawa et al. | 417/321 |

* cited by examiner

*Primary Examiner* — Nathaniel Wiehe
*Assistant Examiner* — Woody A Lee, Jr.
(74) *Attorney, Agent, or Firm* — Muncy, Geissler, Olds & Lowe, P.C.

(57) ABSTRACT

A fan structure is provided, including a hub and a plurality of blades surrounding the hub. Each blade has a first segment connected to the hub and a second segment extended outwardly from the first segment. A first surface is formed between the first segment and the hub, and a second surface is formed between the first and second segments. The first and second surfaces respectively have a first and second setting angle relative to a base plane of the fan structure, wherein the first setting angle exceeds the second setting angle.

13 Claims, 10 Drawing Sheets

FAN STRUCTURE

CROSS REFERENCE TO RELATED APPLICATIONS

This Application claims priority of Taiwan Patent Application No. 099138038, filed on Nov. 5, 2010, the entirety of which is incorporated by reference herein.

BACKGROUND OF THE INVENTION

1. Field of the Invention

This application relates in general to a method for forming an antenna structure and in particular to a method for forming an antenna structure on a non-conductive frame.

2. Description of the Related Art

Referring to FIG. 1*a*, a conventional fan structure usually comprises a hub A and a plurality of blades B surrounding the hub A. When the fan rotates, the blades B can create an axial flow of air. As shown in FIG. 1*b*, the conventional blade B may have a single curved profile. The air flow can be increased by raising the setting angle a or rotation speed of the fan structure. However, the air flow can be separated from the blade B due to a high setting angle, thus leading to aerodynamic noise and an adverse affect on the efficiency of the fan. Note that the vibration and noise issues may also arise when increasing the rotation speed of the fan.

In a conventional fan structure, a high air pressure gradient usually occurs in an outer local region of the blade, such as the region D1 shown in FIG. 1*c*. Since the region D1 is not averagely distributed on the blade, eddy flow and separation of the air flow from the blade may occur, thus adversely reducing aerodynamic efficiency of the fan.

BRIEF SUMMARY OF INVENTION

This application provides a fan structure including hub and a plurality of blades surrounding the hub. Each blade has a first segment connected to the hub and a second segment extended outwardly from the first segment. A first surface is formed between the first segment and the hub, and a second surface is formed between the first and second segments. The first and second surfaces respectively have a first and second setting angle relative to a base plane of the fan structure, wherein the first setting angle exceeds the second setting angle.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 2:
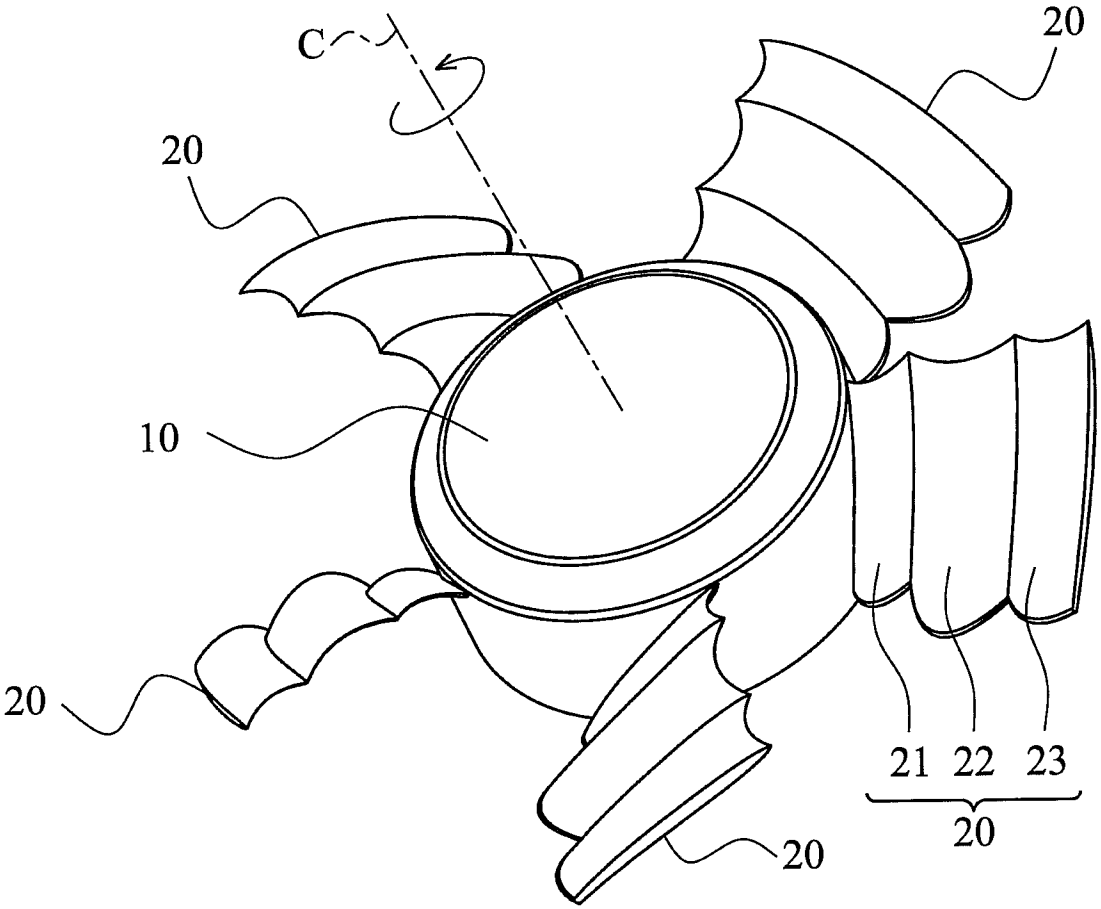
FIG. 2 is a perspective diagram of a fan structure according to an embodiment of the invention.
Figure 3:
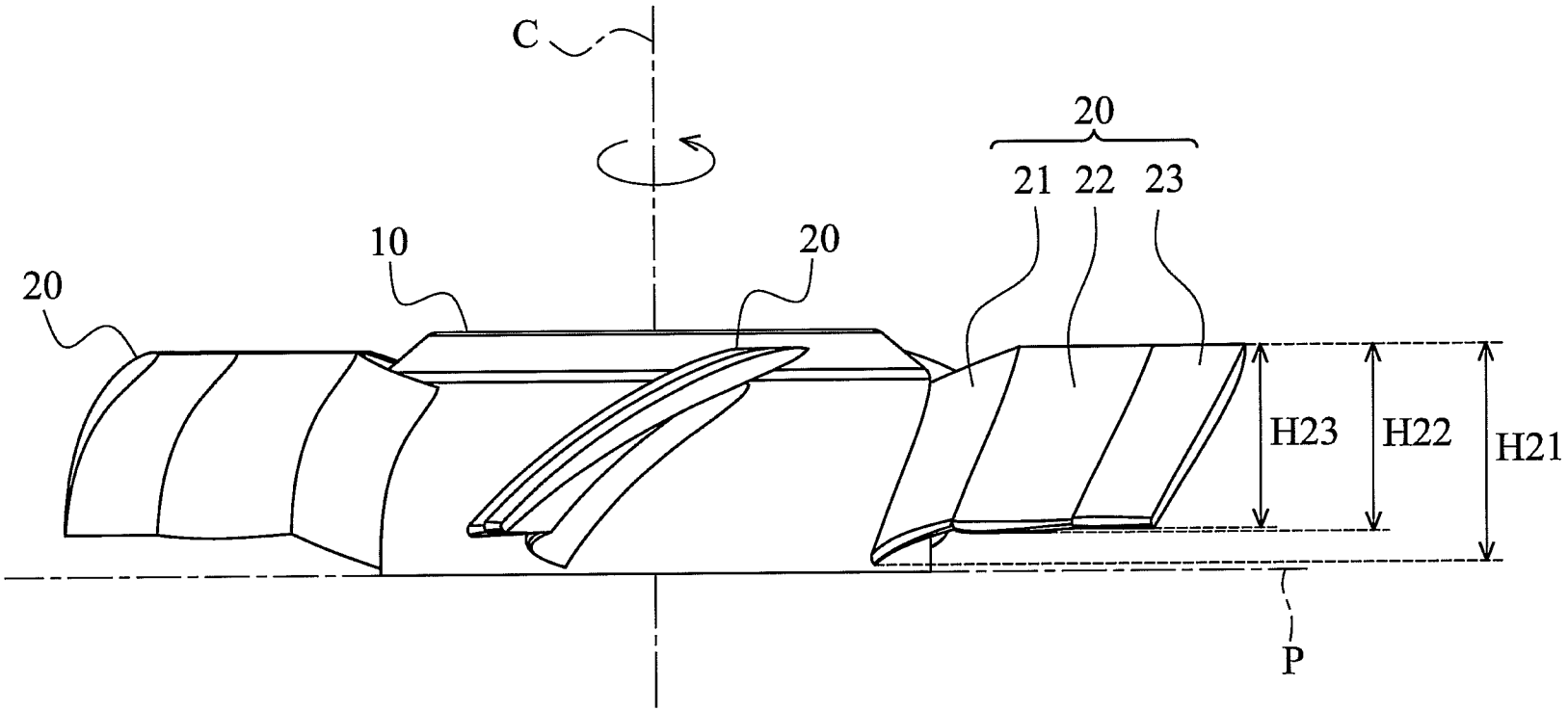
FIG. 3 is a side view of the fan structure in FIG. 2.

Referring to FIGS. 2 and 3, an embodiment of a fan structure primarily comprises a round hub 10 and a plurality of blades 20 fixed to the outer surface of the hub 10. When the fan structure rotates around a central axis C, the blades 20 can create axial flow of air. Specifically, the blade 20 comprises at least two segments.

In this embodiment, the blade 20 comprises a first segment 21, a second segment 22, and a third segment 23. The first segment 21 is connected to the hub 10, the second segment 22 is extended outwardly from the first segment 21, and the third segment 23 is extended outwardly from the second segment 22. As shown in FIG. 3, the fan structure is substantially parallel to a base plane P, which is perpendicular to the central axis C. The first, second, and third segments 21, 22, and 23 respectively have a vertical height H21, H22, and H23 along the central axis C, wherein H21≥H22≥H23.

Figure 4:
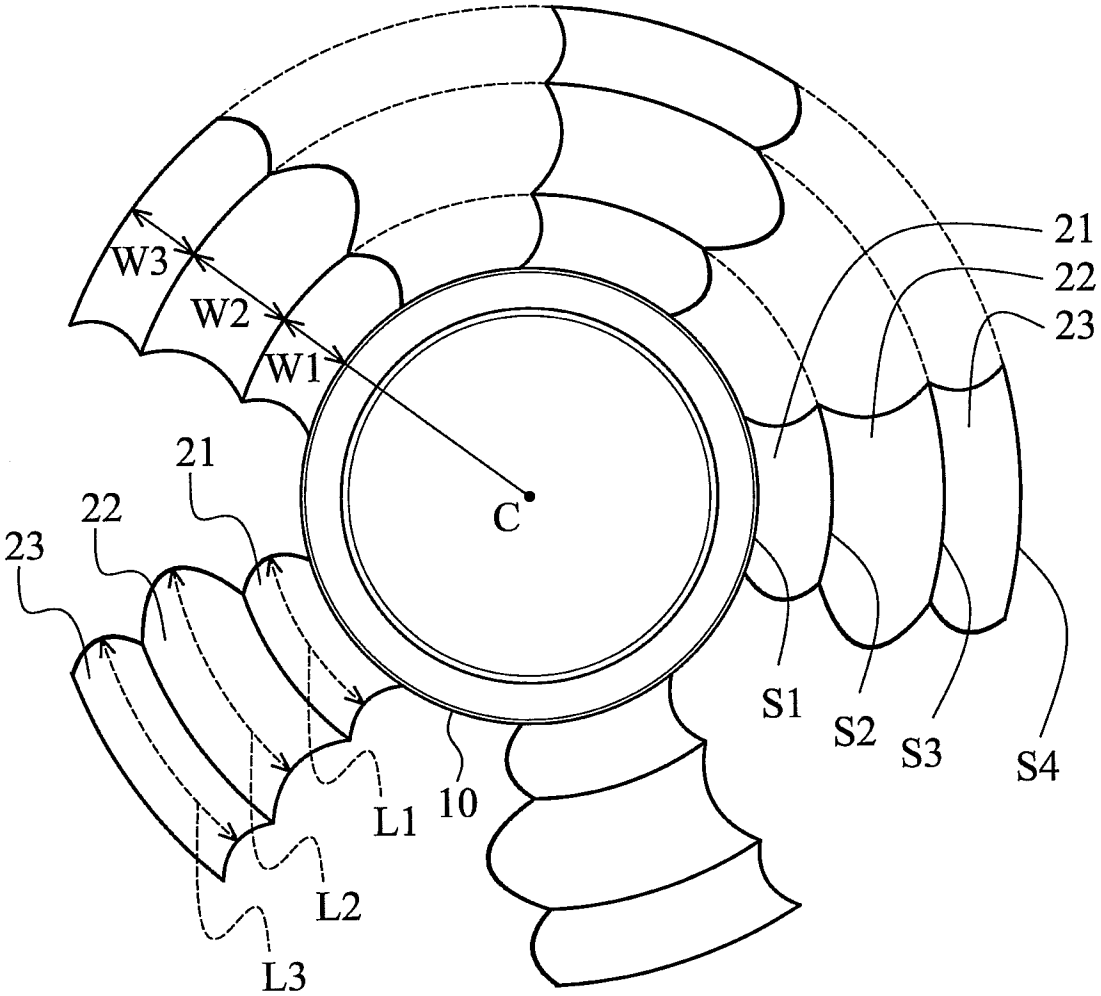
FIG. 4 is a top view of the fan structure in FIG. 2.
Figure 5:
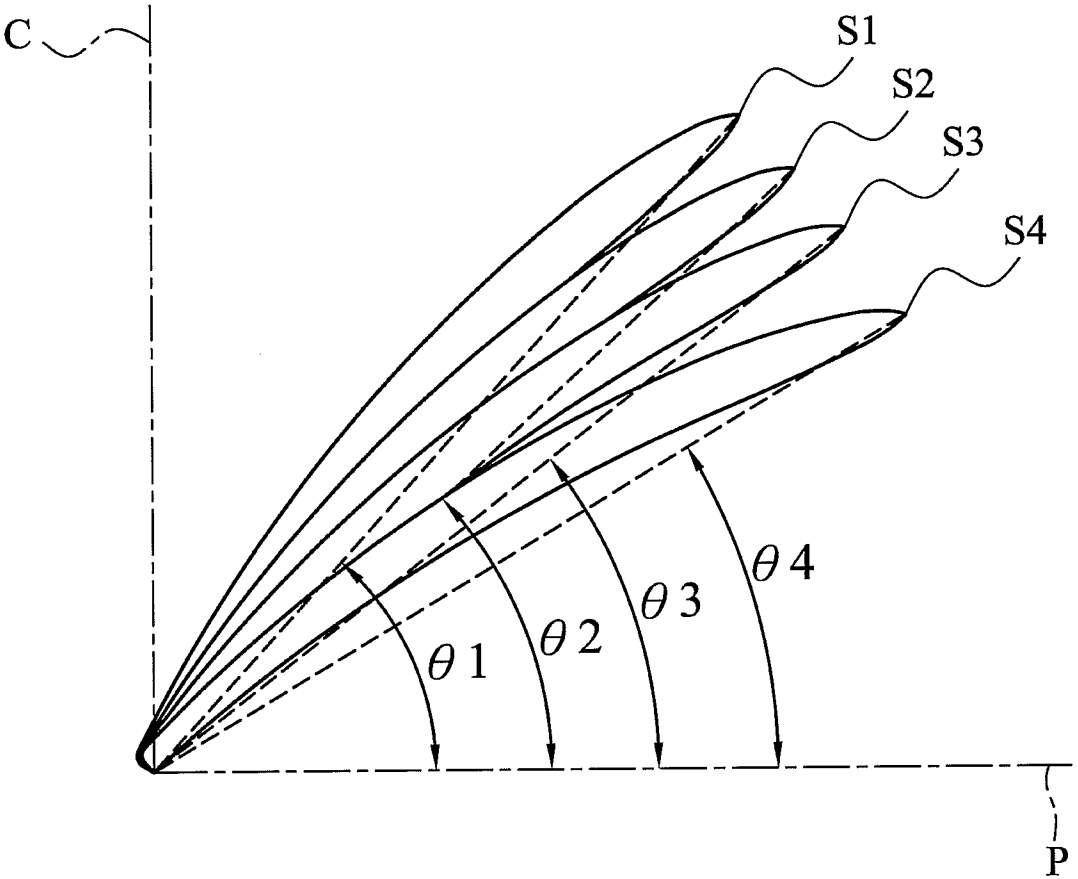
FIG. 5 illustrates the different setting angles of the first, second, third, and fourth surfaces according to an embodiment of the invention.

Referring to FIGS. 4 and 5, each of the blades 20 forms a first surface S1 between the hub 10 and the first segment 21, a second surface S2 between the first segment 21 and the second segment 22, a third surface S3 between the second segment 22 and the third segment 23, and a fourth surface S4 on an outer edge of the blade 20. Specifically, the first, second, third, and fourth surfaces S1, S2, S3, and S4 are configured as concentric circles having a center of the curvature on the central axis C. As shown in FIG. 5, the first, second, third, and fourth surfaces S1, S2, S3, and S4 respectively have a first, second, third, and fourth setting angle θ1, θ2, θ3, and θ4 relative to the base plane P, wherein θ1>θ2>θ3>θ4, and θ1−θ4<20°.

In FIG. 4, the first, second, and third segments 21, 22, and 23 respectively have a radius width of W1, W2, and W3, wherein W1=W2=W3. However, the ratio of the radius widths W1, W2, and W3 can be adjusted for practical applications. In this embodiment, the first, second, and third segments 21, 22, and 23 respectively define a first, second, and third middle line L1, L2, and L3. The first and second surfaces S1 and S2 are equidistant from the first middle line L1 of the first segment 21. Similarly, the second and third surfaces S2 and S3 are equidistant from the second middle line L2 of the second segment 22, and the third and fourth surfaces S3 and S4 are equidistant from the third middle line L3 of the third segment 23. Here, the second middle line L2 is longer than the first and third middle lines L2 and L3. However, the lengths of the first, second, and third middle lines L1, L2, and L3 can also be adjusted for practical applications.

Figure 6:
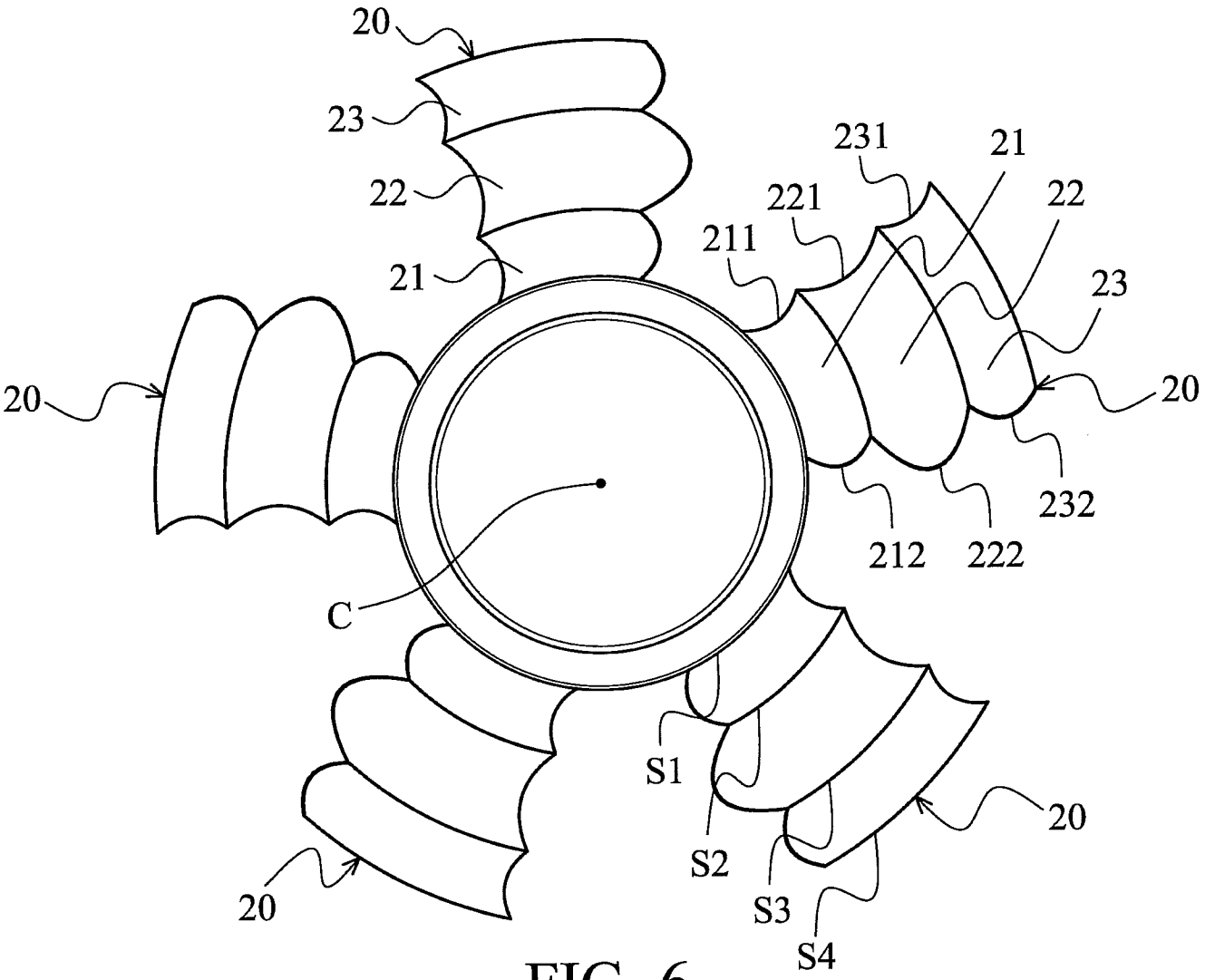
FIG. 6 is a top view of the fan structure in FIG. 2.

Referring to FIG. 6, the first segment 21 forms a first concave windward edge 211 and a first convex leeward edge 212 connecting the first surface S1 with the second surface S2. Similarly, the second segment 22 forms a second concave windward edge 221 and a second convex leeward edge 222 connecting the second surface S2 with the third surface S3, and the third segment 23 forms a third concave windward edge 231 and a third convex leeward edge 232 connecting the third surface S3 with the fourth surface S4.

Figure 1A:
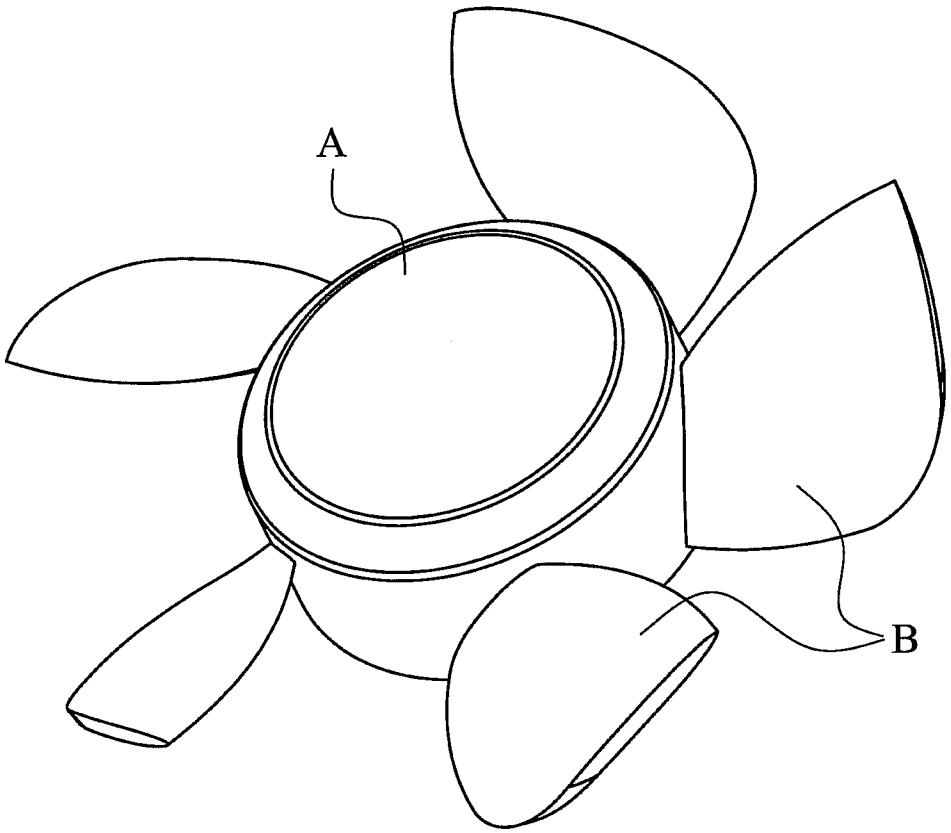
FIG. 1*a* is a perspective diagram of a conventional fan structure.
Figure 1B:
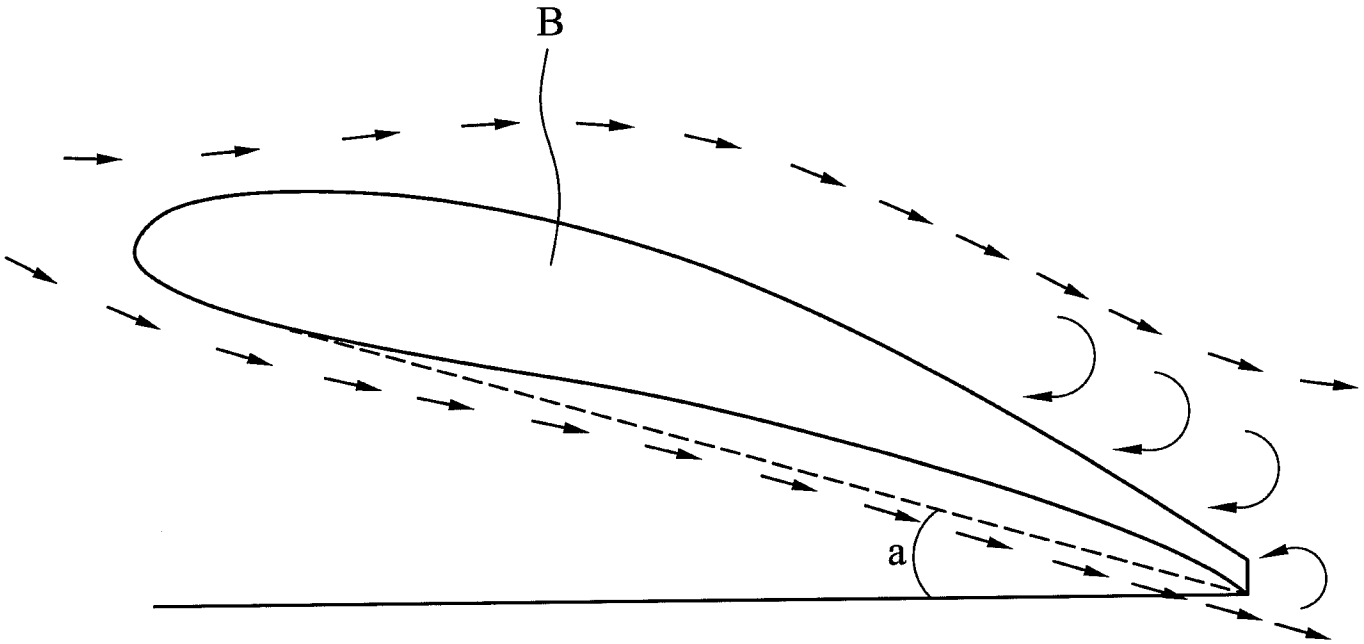
FIG. 1*b* illustrates a flow field around a blade of a conventional fan structure.
Figure 1C:
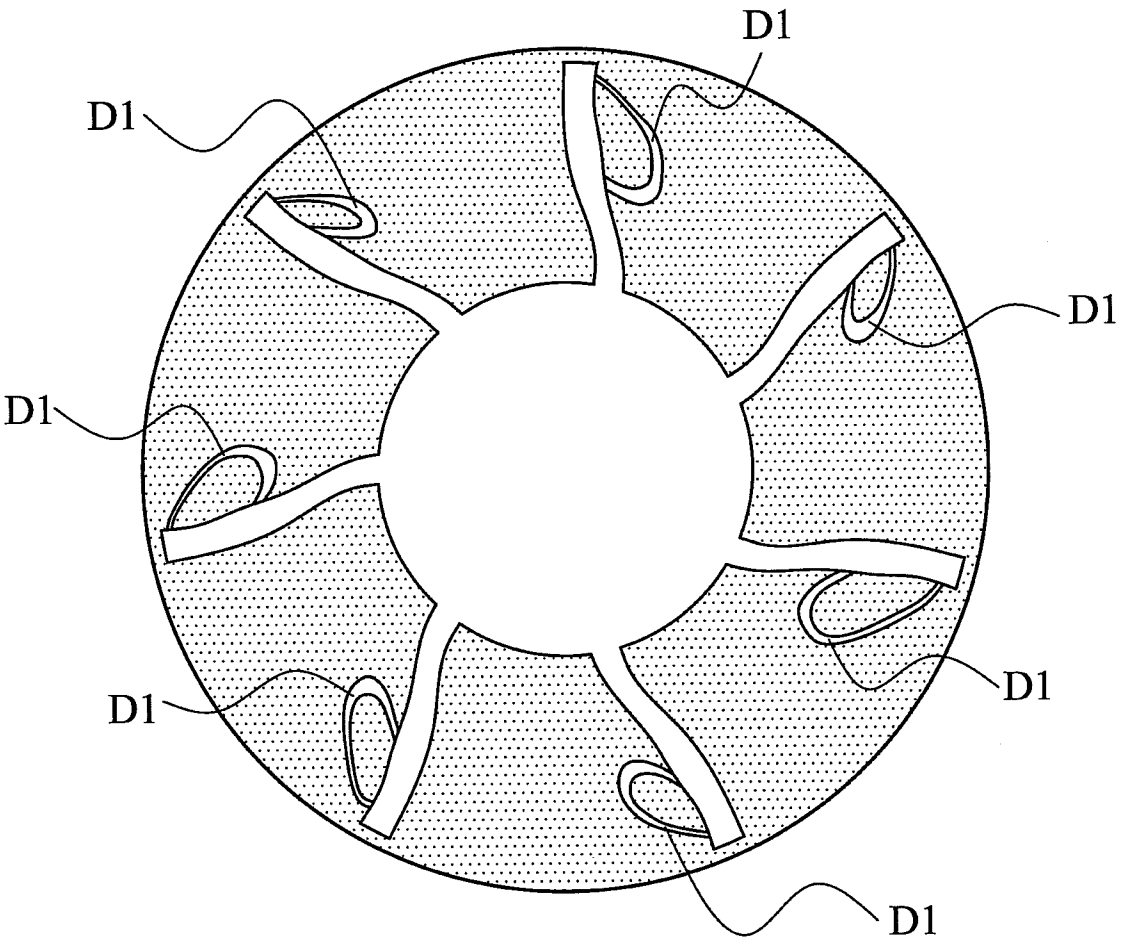
FIG. 1*c* is a pressure distribution diagram of a conventional fan structure.
Figure 7:
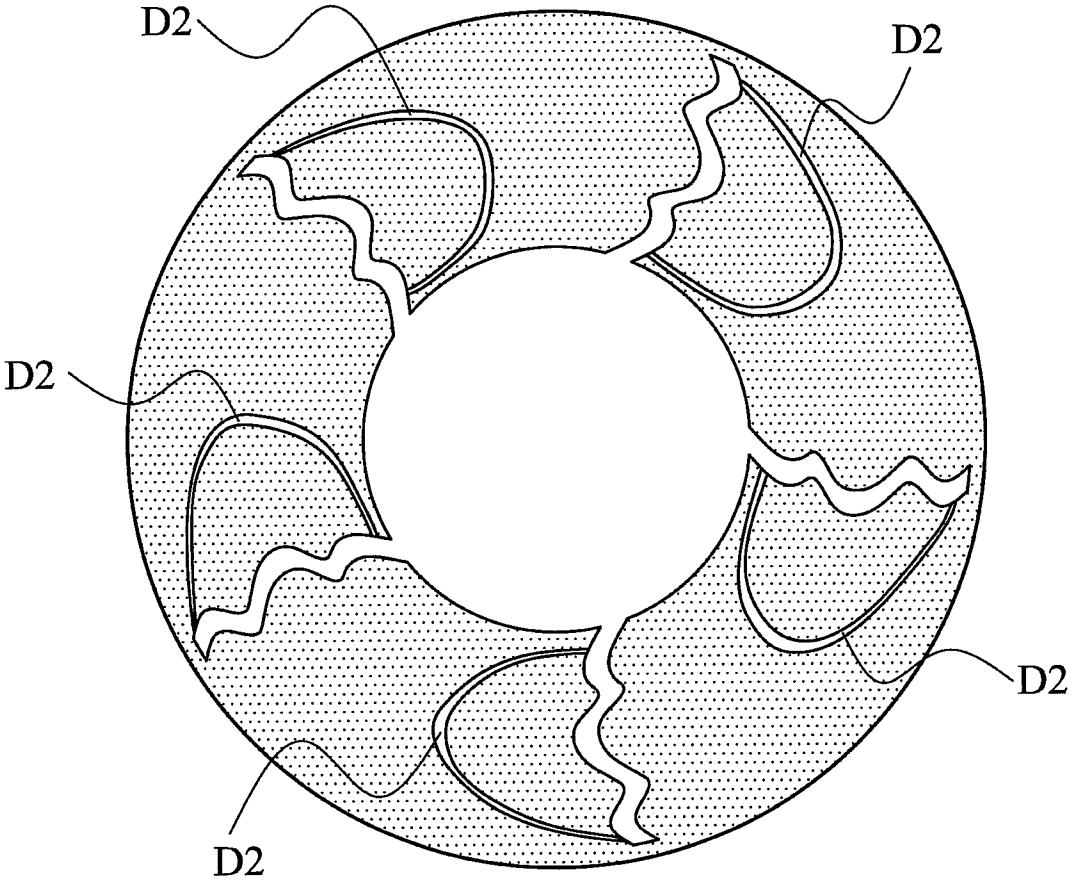
FIG. 7 is a pressure distribution diagram of a fan structure according to an embodiment of the invention.
Figure 8:
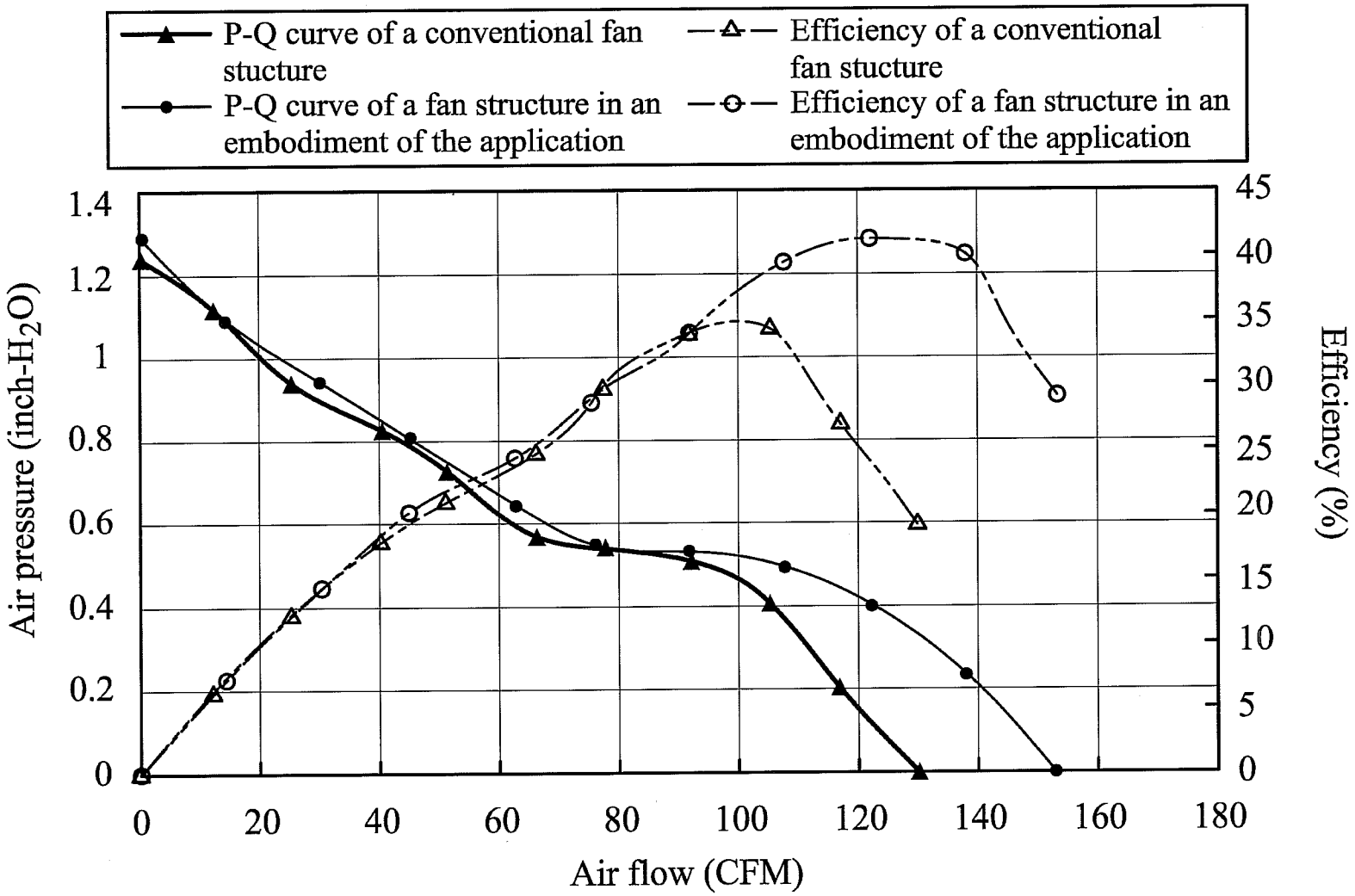
FIG. 8 illustrates P-Q and fan total efficiency curves of a conventional fan structure and a fan structure according to an embodiment of the invention.

Since the high air pressure gradient usually occurs in the outer local region D1 of a conventional fan blade (FIG. 1*c*), eddy flow and separation of the air flow from the blade may occur, thus adversely reducing aerodynamic efficiency of the fan. Comparing the region D2 in FIG. 7 with the region D1 in FIG. 1*c*, the fan structure of the invention can broaden the region with high air pressure gradient. With broad distribution of the region D2 on the blade, eddy flow and separation of the air flow from the blade can be prevented. Moreover, pressure loading and aerodynamic efficiency of the fan structure are improved. Referring to FIG. 8, comparing the P-Q and fan total efficiency curves of the conventional fan structure with the fan structure of the present application, the fan structure of the present application can improve aerodynamic performance of the fan structure.

The invention provides a fan structure with multiple blades. Each of the blades may comprise two or more segments to form a twisted configuration. In some embodiments, the setting angles of the segments can decrease gradually from the hub to the outer edge of the blade. Each of the segments may have a curved concave windward edge and a curved convex leeward edge for concentrating air flow, increasing flow rate, and reducing aerodynamic noise, so as to achieve high efficiency and low power consumption of the fan structure.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A fan structure, comprising:

a hub; and a plurality of blades surrounding the hub, wherein each of the blades comprises:

a first segment connected to the hub, wherein the first segment and the hub form a first surface therebetween, and the first surface has a first setting angle relative to a base plane of the fan structure, and the base plane is perpendicular to a central axis of the fan structure;

a second segment extended outwardly from the first segment, wherein the second segment and the first segment form a second surface therebetween, and the second surface has a second setting angle relative to the base plane of the fan structure, and the first setting angle exceeds the second setting angle; and a third segment extended outwardly from the second segment, wherein the second and third segments form a third surface therebetween, and the third segment forms a fourth surface opposite to the third surface, wherein the height of the second segment along the central axis is less than that of the first segment, and the height of the third segment along the central axis is less than that of the second segment;

wherein the first and second surfaces are equidistant from a first middle line of the first segment, the second and third surfaces are equidistant from a second middle line of the second segment, and the third and fourth surfaces are equidistant from a third middle line of the third segment, wherein the second middle line is longer than the third middle line.

2. The fan structure as claimed in claim 1, wherein the first segment forms a first concave windward edge connecting to the first and second surfaces, and the second segment forms a second concave windward edge and a third surface opposite to the second surface, and the second concave windward edge connects to the second and third surfaces.

3. The fan structure as claimed in claim 1, wherein the first segment has a first convex leeward edge connecting to the first and second surfaces, and the second segment has a second convex leeward edge and a third surface opposite to the second surface, and the second convex leeward edge connects to the second and third surfaces.

4. The fan structure as claimed in claim 1, wherein the radius width of the first segment is substantially equal to that of the second segment.

5. The fan structure as claimed in claim 1, wherein the centers of the curvature of the first and second surfaces are located on the central axis.

6. The fan structure as claimed in claim 1, wherein the third surface has a third setting angle relative to the base plane of the fan structure, and the second setting angle exceeds the third setting angle.

7. The fan structure as claimed in claim 6, wherein the third segment forms a third concave windward edge, and the third concave windward edge connects to the third and fourth surfaces.

8. The fan structure as claimed in claim 6, wherein the third segment forms a third convex leeward edge and a fourth surface opposite to the third surface, and the third convex leeward edge connects to the third and fourth surfaces.

9. The fan structure as claimed in claim 6, wherein the fourth surface is formed on an outer edge of the blade, and the fourth surface has a fourth setting angle relative to the base plane of the fan structure, and the third setting angle exceeds the fourth setting angle.

10. The fan structure as claimed in claim 9, wherein the centers of the curvature of the first and second segments are located on the central axis.

11. The fan structure as claimed in claim 9, wherein the difference between the first and fourth setting angles is less than 20°.

12. The fan structure as claimed in claim 6, wherein the radius width of the third segment is substantially equal to that of the first and second segments.

13. The fan structure as claimed in claim 6, wherein the center of the curvature of the third surface is located on the central axis.

* * * * *